US008631654B2

(12) United States Patent
Bethke

(10) Patent No.: US 8,631,654 B2
(45) Date of Patent: Jan. 21, 2014

(54) BURNER SYSTEM AND METHOD FOR DAMPING SUCH A BURNER SYSTEM

(75) Inventor: Sven Bethke, Greenville, SC (US)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/388,347

(22) PCT Filed: Mar. 7, 2011

(86) PCT No.: PCT/EP2011/053356

§ 371 (c)(1),
(2), (4) Date: Aug. 8, 2012

(87) PCT Pub. No.: WO2011/134706

PCT Pub. Date: Nov. 3, 2011

(65) Prior Publication Data

US 2012/0291438 A1 Nov. 22, 2012

(30) Foreign Application Priority Data

Apr. 28, 2010 (EP) ..... 10161306

(51) Int. Cl.
*F02C 7/24* (2006.01)

(52) U.S. Cl.
USPC ..... 60/725

(58) Field of Classification Search
USPC ..... 60/737, 748, 756, 39.37, 725; 181/213; 244/1 N
See application file for complete search history.

(56) References Cited

U.S. PATENT DOCUMENTS

| | | | | |
|---|---|---|---|---|
| 5,373,695 | A | 12/1994 | Aigner et al. | |
| 7,246,493 | B2 | 7/2007 | Flohr et al. | |
| 2005/0223707 | A1 * | 10/2005 | Ikeda et al. | 60/725 |
| 2008/0190111 | A1 * | 8/2008 | Tiribuzi | 60/725 |
| 2010/0132375 | A1 | 6/2010 | Tanimura et al. | |

FOREIGN PATENT DOCUMENTS

| | | | |
|---|---|---|---|
| CN | 1257179 | A | 6/2000 |
| CN | 101263343 | A | 9/2008 |
| EP | 0597138 | A1 | 5/1994 |
| EP | 1703208 | A1 | 9/2006 |
| EP | 2154434 | A1 | 2/2010 |
| JP | 2004332721 | A | 11/2004 |
| JP | 2005048992 | A | 2/2005 |
| WO | WO 93/10401 | A1 | 5/1993 |
| WO | WO 03/074936 | A1 | 9/2003 |

* cited by examiner

*Primary Examiner* — Phutthiwat Wongwian
*Assistant Examiner* — Scott Walthour

(57) ABSTRACT

A burner system is provided that includes at least two adjacent burners that are separate from each other. Each of the two burners has at least one combustion chamber and a head end. The head end includes at least a fuel injection and a fuel-air premix. Each burner has a cap with a cap side and cap upper side, wherein at least the cap upper side is arranged ahead of the head end, seen in the direction of flow. In this manner, a burner plenum is formed between the cap upper side and the head end. The at least two burner plenums thus formed have an acoustic connection. A method for damping such a burner system is also provided.

2 Claims, 2 Drawing Sheets

BURNER SYSTEM AND METHOD FOR DAMPING SUCH A BURNER SYSTEM

CROSS REFERENCE TO RELATED APPLICATIONS

This application is the U.S. National Stage of International Application No. PCT/EP2011/053356, filed Mar. 7, 2011 and claims the benefit thereof. The International Application claims the benefits of European patent application No. 10161306.5 filed Apr. 28, 2010. All of the applications are incorporated by reference herein in their entirety.

FIELD OF INVENTION

The invention relates to a burner system having at least two adjacent burners that are separate from each other, each of which has at least one combustion chamber and a head end, wherein the latter comprises at least a fuel injection means and a fuel-air premix means, wherein each burner has a cap with a cap side and a cap top side, wherein at least the cap top side is arranged ahead of the head end, viewed in the direction of flow, and wherein a burner plenum is formed thereby between the cap top side and the head end.

BACKGROUND OF INVENTION

In combustion systems such as gas turbines, aircraft engines, rocket motors and heating installations, thermoacoustically induced combustion oscillations can occur as a result of an interaction between the combustion flame and the release of heat associated therewith and acoustic pressure variations. An acoustic excitation can cause the position of the flame, the flame front surface or the composition of the mixture to fluctuate, thereby in turn causing variations in the release of heat. A constructive phase relationship can lead to the occurrence of positive feedback and amplification. Such an amplified combustion oscillation can result in significant noise exposure and damage due to vibrations.

The acoustic properties of the combustion chamber and the boundary conditions present at the combustion chamber inlet and combustion chamber outlet and at the combustion chamber walls have a significant impact on these thermoacoustically induced instabilities. The acoustic properties can be modified by installing Helmholtz resonators.

WO 93/10401 A1 discloses a device for suppressing combustion oscillations in a combustion chamber of a gas turbine installation. A Helmholtz resonator is fluidically connected to a fuel feed line. This causes the acoustic properties of the feed line or of the overall acoustic system to be changed in such a way that combustion oscillations are suppressed. It has nonetheless been shown that this measure is not sufficient in all operating states, since combustion oscillations can still occur even when oscillations in the fuel line are suppressed.

WO 03/074936 A1 discloses a gas turbine having a burner which leads into a combustion chamber at a combustor port, said combustor port being encircled in a ring-like manner by a Helmholtz resonator. By this means combustion oscillations are effectively damped through close contact with the flame, while temperature irregularities are simultaneously avoided. Capillary tubes which effect a frequency adjustment are arranged in the Helmholtz resonator.

EP 0 597 138 A1 describes a gas turbine combustion chamber which has air-flushed Helmholtz resonators in the region of the burners. The resonators are arranged in an alternating manner on the front side of the combustion chamber between the burners. By means of said resonators oscillation energy of combustion oscillations occurring in the combustion chamber is absorbed and the combustion oscillations are attenuated as a result.

By reason of its function each of these resonators has a connecting aperture to the combustion chamber which must be closed by means of a specific air mass. When the resonators are fixed to the combustion chamber wall, this air mass is no longer available for combustion purposes since it is directed past the burner. The flame temperature and the NOx emissions are increased as a result.

SUMMARY OF INVENTION

The object of the present invention is therefore to disclose a burner system which can be used to damp combustion oscillations and which avoids the aforementioned problems.

According to the invention a burner system is provided having at least two adjacent burners that are separate from each other, each of which has at least one combustion chamber and a head end, the latter comprising at least one fuel injection means and a fuel-air premix means. In this arrangement each burner has a cap having a cap side and a cap top side, at least the cap top side being arranged ahead of the head end, viewed in the direction of flow. The cap side is arranged at least partially around the head end, such that the cap side is spaced apart from the head end in a radial direction. This results in a burner plenum being formed between the cap top side and the head end.

It is known that when tubular combustion chambers are used the performance of gas turbines is limited due to the occurrence of thermoacoustic oscillations in said combustion chambers. It has now been inventively recognized that specifically in the case of the tubular combustion chambers the acoustic interaction between two adjacent combustion chambers that are separate from each other is important. Modes become established here which propagate from one combustion chamber into the other via the connection upstream of the turbine.

The acoustic analysis of the distributions of the acoustic pressure shows that in this case a mode shape is established in which mutually separate adjacent combustion chambers, including the mutually separate plenums upstream of the combustion chambers, oscillate out of phase. According to the invention the at least two burner plenums now have an acoustic connection.

By means of this one suitably implemented acoustic connection of adjacent combustion chambers or, as the case may be, their plenums, the possibility that said mode shape will develop can be suppressed and prevented. It is therefore possible to damp or even to the greatest possible extent prevent thermoacoustic oscillations.

In a preferred embodiment a channel is formed by means of the cap side and the head end. Compressor air is ducted to the plenum through said channel. This compressor air consequently cools the outside of the combustion chamber and in so doing reduces the risk of the combustion chamber overheating. Ideally the compressor air is preheated as a result, enabling a more stable combustion to take place.

Preferably the acoustic connection is a tube connecting burner to plenums, in particular a tube embodied in a ring shape or a channel. This connection can be implemented by particularly simple constructional means.

Preferably each burner with its burner plenum has an acoustic connection to the adjacent burner or burner plenum in each case. In this way the development of a mode shape of all the burners present can be optimally suppressed.

A gas turbine advantageously comprises such a burner system.

The object directed toward the method is achieved by the disclosure of a method for damping oscillations of a burner system having at least two adjacent burners, each of which has at least one combustion chamber and a head end, the latter comprising at least one fuel injection means as well as a fuel-air premix means, wherein each burner has a cap having a cap side and a cap top side, wherein at least the cap top side is arranged ahead of the head end, viewed in the direction of flow, wherein a burner plenum is thereby formed between the cap top side and the head end, and wherein an out-of-phase oscillation of the adjacent burners and their burner plenums is avoided by means of an acoustic connection between two adjacent burner plenums.

This method provides a simplified approach to avoiding or even preventing thermoacoustic oscillations to the greatest possible extent. Accordingly it is possible—in contrast to the prior art—to damp different frequencies occurring.

BRIEF DESCRIPTION OF THE DRAWINGS

Further features, characteristics and advantages of the present invention will emerge from the following description of exemplary embodiments with reference to the accompanying figures, in which.

DETAILED DESCRIPTION OF INVENTION

Figure 1:
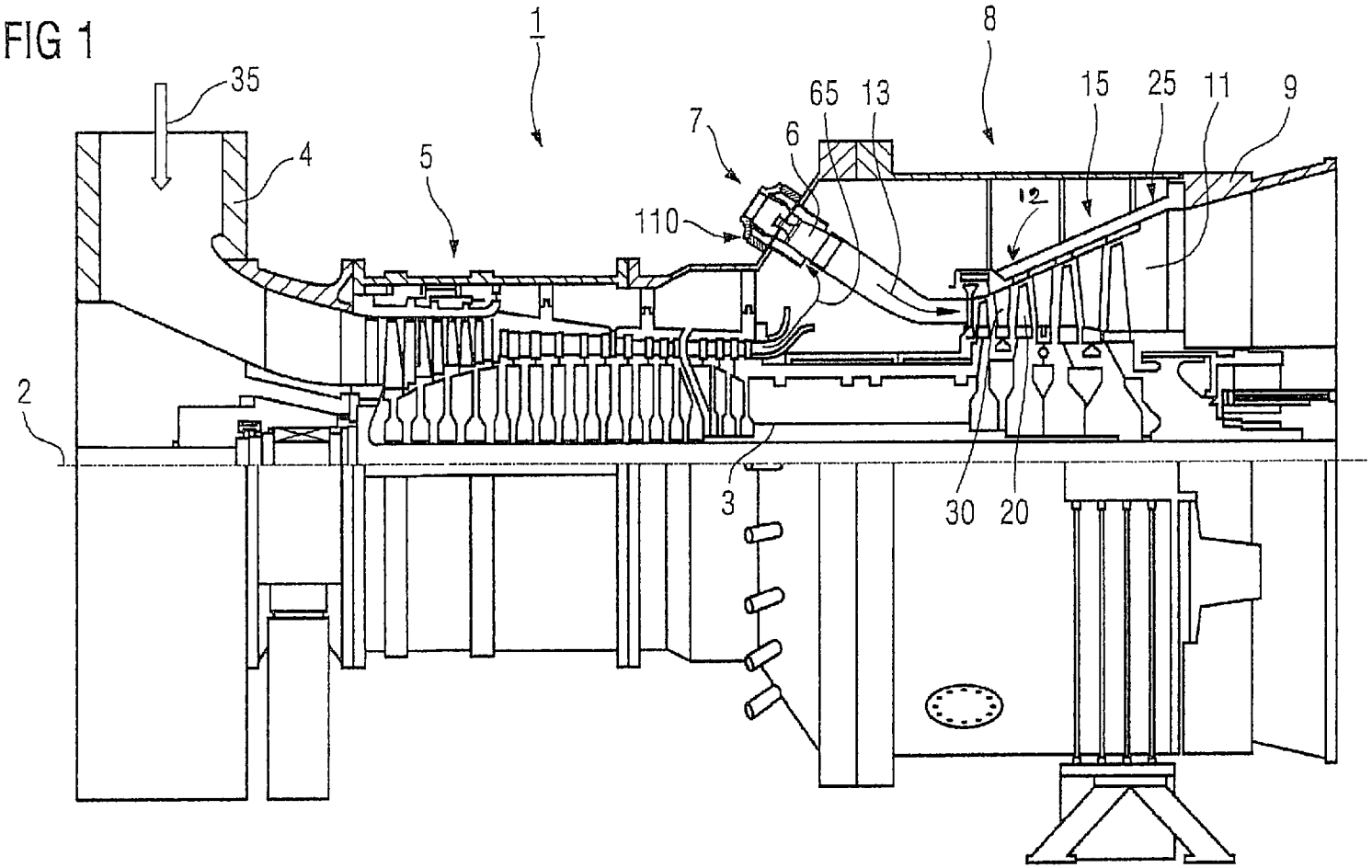
FIG. 1 shows a schematic view of a gas turbine in a partial longitudinal section.

FIG. 1 shows by way of example a gas turbine 1 in a partial longitudinal section.

Internally, the gas turbine 1 has a rotor 3, also referred to as a turbine rotor, mounted so as to be rotatable around an axis of rotation 2 and having a shaft.

Following one another in sequence along the rotor 3 are an intake housing 4, a compressor 5, a (for example torus-like) combustion chamber 6, in particular a tubular or annular combustion chamber, having a plurality of coaxially arranged burners 7, a turbine 8 and the exhaust housing 9.

The combustion chamber 6 communicates with a (for example annular) hot gas duct 11. There, four (for example) turbine stages 12 connected in series form the turbine 8. Each turbine stage 12 is formed for example from two blade rings. Viewed in the direction of flow of a working medium 13, a row of stator blades 15 is followed in the hot gas duct 11 by a row 25 formed from rotor blades 20.

During the operation of the gas turbine 1, air 35 is ingested through the intake housing 4 by the compressor 5 and compressed. The compressed air provided at the downstream end of the compressor 5 is conducted to the burners 7, where it is mixed with a fuel. The mixture is then combusted in the combustion chamber 6, forming the working medium 13 in the process. From there, the working medium 13 flows along the hot gas duct 11 past the stator blades 30 and the rotor blades 20. At the rotor blades 20, the working medium 13 expands in a pulse-transmitting manner, causing the rotor blades 20 to drive the rotor 3 and the latter to drive the work machine coupled to it.

Figure 2:
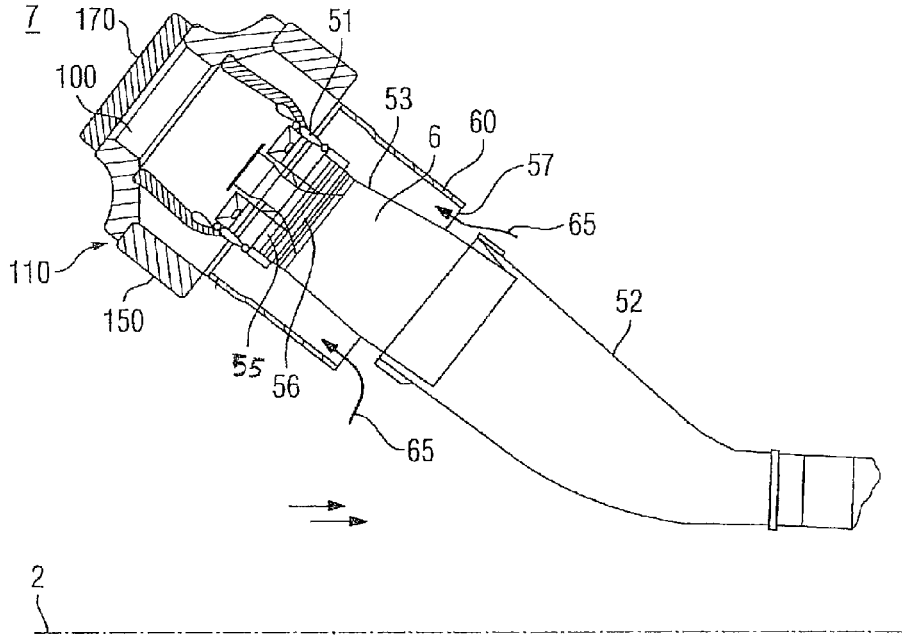
FIG. 2 shows a tubular combustion chamber with cap.

The burner 7 is preferably used in conjunction with what is termed a tubular combustion chamber 6 (FIG. 2). In this case the gas turbine 1 has a plurality of tubular combustion chambers 6 that are separate from one another and arranged in a ring shape, the downstream ports of which lead into the annular hot gas duct 11 on the turbine inlet side. In this scheme a plurality of burners 7, for example six or eight, are arranged preferably at each of said tubular combustion chambers mostly in a ring shape around a pilot burner at the opposite end of the downstream-side port of the tubular combustion chambers 6.

Figure 3:
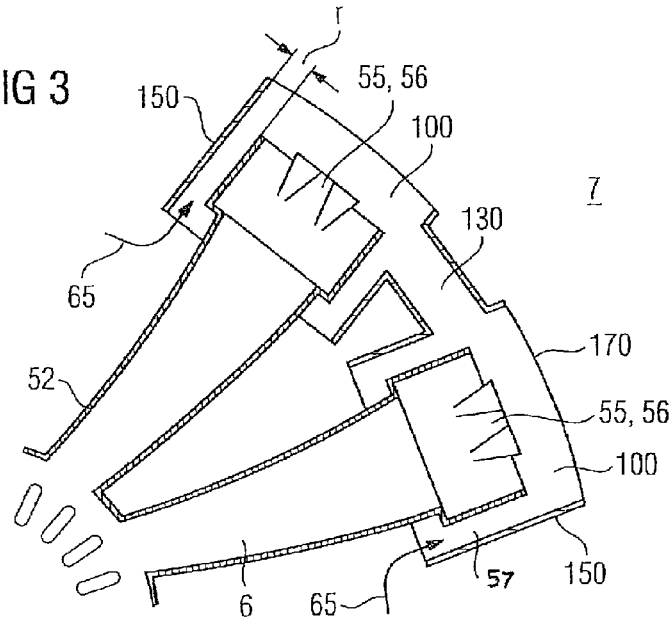
FIG. 3 shows a schematic view of the inventive connection between the burner plenums.

FIG. 2 shows a schematic sectional view of a tubular burner 7. The burner 7 comprises a head end 51, a transition channel (transition) 52 and, disposed therebetween, a liner 53. Here, the section of the fuel injection means 55/fuel-air premix means 56 of the burner is essentially referred to as the "head end 51". The liner 53 extends in an arbitrary manner from the head end to the transition 52. Liner 53 and flow-directing shroud 60 together form an annular passage 57 through which combustion/cooling air 65 flows in. The chamber upstream of the fuel injection means 55 and/or fuel/air premix means 56 is referred to as the burner plenum (plenum) 100. The burner 7 has a cap 110 having a cap side 150 and a cap top side 170. In this case at least the cap top side 170 is arranged ahead of the head end 51, viewed in the direction of flow, as a result of which a burner plenum 100 is formed between the cap top side 170 and the head end 51. The cap 110 has a first side facing toward the combustion chamber and a second side facing away from the combustion chamber (FIG. 3). The cap 110 is arranged in this case with the cap side 150 effectively outside of the machine.

FIG. 3 shows the inventive burner system comprising two mutually separate adjacent burners 7, each of which has a tubular combustion chamber 6 and a head end 51. Each of the burners 7 has a cap 110 having a cap side 150 and a cap top side 170. In this case at least the cap top side 170 is arranged ahead of the head end 51, viewed in the direction of flow, as a result of which a burner plenum 100 is formed between the cap top side 170 and the head end 51. An acoustic connection 130 is present between the two adjacent burner plenums 100. Said acoustic connection is in this case advantageously annular and accordingly interconnects the respective adjacent burner plenums 100 of the burners 7 of the overall gas turbine. The annular connection can be realized for example by means of a tube that connects the individual plenums 100 to one another. Such a connection 130 can be realized in the region of the plenums 100 without great additional constructional effort. The annular connection thus ends at the burner plenum 100 at which it began. Consequently no more modes are established that propagate from one combustion chamber into the other via the connection upstream of the turbine, thereby causing the combustion chambers with their plenums to oscillate out of phase. The acoustic connection 130 suppresses and prevents the formation of such a mode shape.

The invention claimed is:

1. A burner system, comprising:

at least two adjacent burners that are separate from each other, each of the at least two burners comprising:

at least one combustion chamber, a head end comprising at least one fuel injection means and a fuel-air premix means, and a cap having a cap side and a cap top side, wherein at least the cap top side is arranged ahead of the head end, viewed in the direction of flow, such that a respective burner plenum is formed between the cap top side and the head end, wherein the cap side is arranged at least partially around the head end, and wherein the cap side is spaced apart from the head end in a radial direction, wherein the respective burner plenum of each burner has an acoustic connection to the separate and adjacent at least one other burner's respective burner plenum, wherein the acoustic connection is a ring shaped tube connecting the burner plenums, the ring shaped tube forming an annular channel passing from one burner plenum through the next adjacent burner plenum and ending in the same burner plenum in which it began, and wherein an annular passage for compressor air is defined by the cap side and the head end.

2. A gas turbine comprising:

a compressor for compressing air ingested through an intake, a burner system where the compressed air is mixed with a fuel, the burner system comprising:

at least two adjacent burners that are separate from each other, each of the at least two burners comprising:

at least one combustion chamber, a head end comprising at least one fuel injection means and a fuel-air premix means, and a cap having a cap side and a cop top side, wherein at least the cap top side is arranged ahead of the head end, viewed in the direction of flow, such that a respective burner plenum is formed between the cap top side and the head end, wherein the cap side is arranged at least partially around the head end, and wherein the cap side is spaced apart from the head end in a radial direction, wherein the respective burner plenum of each burner has an acoustic connection to the separate and adjacent at least one other burner's respective burner plenum, wherein the acoustic connection is a ring shaped tube connecting the burner plenums, the ring shaped tube defining an annular channel passing from one burner plenum through the next adjacent burner plenum and ending in the same burner plenum in which it began, and wherein an annular passage for compressor air is defined by the cap side and the head end, a combustion chamber for combusting the mixture of air and fuel to produce a working medium, and a turbine for expanding the working medium.

* * * * *